US009728128B2

(12) United States Patent
Li et al.

(10) Patent No.: US 9,728,128 B2
(45) Date of Patent: Aug. 8, 2017

(54) PIXEL CIRCUIT, DRIVING METHOD THEREOF AND DISPLAY PANEL

(71) Applicants: Shanghai Tianma AM-OLED Co., Ltd., Shanghai (CN); TIANMA MICRO-ELECTRONICS CO., LTD., Shenzhen (CN)

(72) Inventors: Song Li, Shanghai (CN); Liyuan Luo, Shanghai (CN); Gang Liu, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 145 days.

(21) Appl. No.: 14/801,786

(22) Filed: Jul. 16, 2015

(65) Prior Publication Data

US 2016/0117983 A1 Apr. 28, 2016

(30) Foreign Application Priority Data

Oct. 28, 2014 (CN) ..... 2014 1 0588530

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0852* (2013.01); *G09G 2300/0861* (2013.01)

(58) Field of Classification Search
CPC ..... G09G 3/3233; G09G 2300/0852; G09G 2300/0819; G09G 2300/0861; G09G 2330/02; G09G 2300/0842; G09G 2320/0233
See application file for complete search history.

(56) References Cited

U.S. PATENT DOCUMENTS

2008/0218452 A1 9/2008 Kohno et al.
2009/0108763 A1* 4/2009 Han ..... G09G 3/3233 315/169.3
2011/0199357 A1* 8/2011 Chung ..... G09G 3/3233 345/211

(Continued)

FOREIGN PATENT DOCUMENTS

CN 102339586 A 2/2012
KR 20140030455 A 3/2014

*Primary Examiner* — Premal Patel
(74) *Attorney, Agent, or Firm* — Alston & Bird LLP

(57) ABSTRACT

A circuit is disclosed. The circuit includes a first transistor, to respond to a first scanning signal and to transmit a first voltage, a first capacitor, to store the first voltage, and an organic light emitting diode. The circuit also includes a second transistor, to provide a current to the organic light emitting diode, a third transistor, to respond to a second scanning signal and to transmit a first potential signal to the second transistor, and a fourth transistor, to respond to the first scanning signal and to form a diode connection of the second transistor. The circuit also includes a fifth transistor, to respond to a third scanning signal and to transmit a second signal voltage to the second transistor, and a sixth transistor, to respond to a light emitting scanning signal, and to output the current to the organic light emitting diode.

14 Claims, 12 Drawing Sheets

(56) References Cited

U.S. PATENT DOCUMENTS

| | | | | |
|---|---|---|---|---|
| 2012/0199854 | A1* | 8/2012 | Noguchi | H01L 27/3276 257/88 |
| 2014/0132583 | A1* | 5/2014 | Kim | G09G 3/3233 345/212 |
| 2015/0130859 | A1* | 5/2015 | Yang | G09G 3/3233 345/690 |
| 2015/0187270 | A1* | 7/2015 | Lee | G09G 3/3233 345/76 |

* cited by examiner

PIXEL CIRCUIT, DRIVING METHOD THEREOF AND DISPLAY PANEL

CROSS-REFERENCES TO RELATED APPLICATIONS

This disclosure claims the benefit of Chinese Patent Disclosure No. 201410588530.2, filed with the Chinese Patent Office on Oct. 28, 2014 and entitled "Pixel Circuit, Driving Method Thereof And Display Panel", which is incorporated herein by reference in its entirety for all purposes.

TECHNICAL FIELD

The present disclosure relates to a flat-panel displayer, and particularly relates to a pixel circuit in an organic light emitting device capable of compensating a threshold, a driving method thereof and a display panel.

BACKGROUND OF THE INVENTION

Generally, organic light emitting devices can be classified as passive matrix organic light emitting diodes (OLED, organic light emitting diode) and active matrix OLED (AMOLED, active matrix OLED), and according to the manner of driving an EL element, can be classified as current driven OLEDs and voltage driven OLEDs. A typical AMOLED generally includes a plurality of gate lines, a plurality of data lines, a plurality of power lines and a plurality of pixels connected to these lines and arranged in a rectangular form. Each pixel usually includes: one EL element; two transistors, one is a switching transistor used for transmitting a data signal, and the other is a driving transistor used for driving the EL element according to the data signal; and a capacitor used for maintaining the data voltage.

Although the AMOLED has the advantages of low power consumption, however there is a phenomenon that the driving transistor turns on the light emitting diode at a gate potential reset stage, which resulting in insufficient darkness of an OLED display panel when working at a dark state and directly resulting in an insufficient contrast ratio of the OLED display panel.

BRIEF SUMMARY OF THE INVENTION

One inventive aspect is a pixel circuit. The pixel circuit includes a first transistor, configured to respond to a first scanning line signal and to transmit a first signal voltage, a first capacitor, configured to store the first signal voltage, and an organic light emitting diode. The pixel circuit also includes a second transistor, configured to provide a drive current to the organic light emitting diode, a third transistor, configured to respond to a second scanning line signal and to transmit a first potential signal to the second transistor, and a fourth transistor, configured to respond to the first scanning line signal and to electrically connect a first electrode of the second transistor to a third electrode of the second transistor to form a diode connection of the second transistor. The pixel circuit also includes a fifth transistor, configured to respond to a third scanning line signal and to transmit a second signal voltage to the second transistor, and a sixth transistor, configured to respond to a light emitting scanning line signal, to receive the drive current of the second transistor, and to output the drive current to the organic light emitting diode.

Another inventive aspect is a method of driving a pixel circuit. The pixel circuit includes a first transistor, configured to respond to a first scanning line signal and to transmit a first signal voltage, a first capacitor, configured to store the first signal voltage, and an organic light emitting diode. The pixel circuit also includes a second transistor, configured to provide a drive current to the organic light emitting diode, a third transistor, configured to respond to a second scanning line signal and to transmit a first potential signal to the second transistor, and a fourth transistor, configured to respond to the first scanning line signal and to electrically connect a first electrode of the second transistor to a third electrode of the second transistor to form a diode connection of the second transistor. The pixel circuit also includes a fifth transistor, configured to respond to a third scanning line signal and to transmit a second signal voltage to the second transistor, and a sixth transistor, configured to respond to a light emitting scanning line signal, to receive the drive current of the second transistor, and to output the drive current to the organic light emitting diode. The first transistor includes a gate electrode configured to receive the first scanning line signal, a second electrode configured to receive the first signal voltage, and a third electrode connected to a first electrode of the first capacitor. The second transistor includes a gate electrode connected to a second electrode of the first capacitor, a second electrode configured to receive a first power supply voltage, and a third electrode connected to a second electrode of the sixth transistor. The third transistor includes a gate electrode configured to receive the second scanning line signal, a second electrode connected to the second electrode of the first capacitor, and a third electrode connected to the gate electrode of the third transistor. The fourth transistor includes a gate electrode configured to receive the first scanning line signal, a second electrode connected to the second electrode of the first capacitor, and a third electrode connected to the second electrode of the sixth transistor. The fifth transistor includes a gate electrode configured to receive the third scanning line signal, a second electrode connected to the first electrode of the first capacitor, and a third electrode configured to receive the second signal voltage. The sixth transistor includes a gate electrode configured to receive the light emitting scanning signal, the second electrode of the sixth transistor connected to the third electrode of the second transistor, and a third electrode configured to receive a second power supply voltage. The first electrode of the first capacitor is connected to the third electrode of the first transistor, and the second electrode of the first capacitor is connected to the gate electrode of the second transistor. The method includes during a first time sequence stage, the first transistor and the fourth transistor turn on in response to the first scanning line signal, and the first signal voltage is transmitted to the first electrode of the first capacitor. The method also includes, during a second time sequence stage, the third transistor turns on in response to the second scanning line signal, the first potential signal on the second scanning line signal is transmitted to the second electrode of the first capacitor to reset the gate electrode of the second transistor, and the second transistor is turned on, during a third time sequence stage, the second transistor and the fourth transistor are on, the second transistor is diode connected, and the first power supply voltage is transmitted to the second electrode of the first capacitor through the second transistor. The method also includes, during a fourth time sequence stage, the fifth transistor turns on in response to the third scanning line signal, the second signal voltage is transmitted to the first electrode of the first capacitor, and the potential at the second electrode of the first capacitor changes in response to the second signal voltage being transmitted to the first electrode of the first capacitor. The method also includes, during a fifth time sequence stage, the sixth transistor turns on in response to the light emitting scanning line signal, and the drive current flows to the organic light emitting diode through the sixth transistor.

Another inventive aspect is a method of driving a pixel circuit. The pixel circuit includes a first transistor, configured to respond to a first scanning line signal and to transmit a first signal voltage, a first capacitor, configured to store the first signal voltage, and an organic light emitting diode. The pixel circuit also includes a second transistor, configured to provide a drive current to the organic light emitting diode, a third transistor, configured to respond to a second scanning line signal and to transmit a first potential signal to the second transistor, and a fourth transistor, configured to respond to the first scanning line signal and to electrically connect a first electrode of the second transistor to a third electrode of the second transistor to form a diode connection of the second transistor. The pixel circuit also includes a fifth transistor, configured to respond to a third scanning line signal and to transmit a second signal voltage to the second transistor, and a sixth transistor, configured to respond to a light emitting scanning line signal, to receive the drive current of the second transistor, and to output the drive current to the organic light emitting diode. The first transistor includes a gate electrode configured to receive the first scanning line signal, a second electrode configured to receive the first signal voltage, and a third electrode connected to a first electrode of the first capacitor. The second transistor includes a gate electrode connected to a second electrode of the first capacitor, a second electrode configured to receive a first power supply voltage, and a third electrode connected to a second electrode of the sixth transistor. The third transistor includes a gate electrode configured to receive the second scanning line signal, a second electrode connected to the second electrode of the first capacitor, and a third electrode connected to the gate electrode of the third transistor. The fourth transistor includes a gate electrode configured to receive the first scanning line signal, a second electrode connected to the second electrode of the first capacitor, and a third electrode connected to the second electrode of the sixth transistor. The fifth transistor includes a gate electrode configured to receive the third scanning line signal, a second electrode connected to the first electrode of the first capacitor, and a third electrode configured to receive the second signal voltage. The sixth transistor includes a gate electrode configured to receive the light emitting scanning signal, the second electrode of the sixth transistor connected to the third electrode of the second transistor, and a third electrode configured to receive a second power supply voltage. The first electrode of the first capacitor is connected to the third electrode of the first transistor, and the second electrode of the first capacitor is connected to the gate electrode of the second transistor. The method includes, during a first time sequence stage, the third transistor and the seventh transistor turn on in response to the second scanning line signal, the first signal voltage is transmitted to the first electrode of the first capacitor through the seventh transistor, the first potential signal is transmitted to the second electrode of the first capacitor to reset the gate electrode of the second transistor, and the second transistor is turned on. The method also includes, during a second time sequence stage, the first transistor and the fourth transistor turn on in response to the first scanning line signal, the first signal voltage is transmitted to the first electrode of the first capacitor through the first transistor, the second transistor is diode connected, and the first power supply voltage is transmitted to the second electrode of the first capacitor through the second transistor. The method also includes, during a third time sequence stage, the fifth transistor turns on in response to the third scanning line signal, the second signal voltage is transmitted to the first electrode of the first capacitor, and the potential at the second electrode of the first capacitor changes in response to the second signal voltage being transmitted to the first electrode of the first capacitor. The method also includes, during a fourth time sequence stage, the sixth transistor turns on in response to the light emitting scanning line signal, and the drive current flows to the organic light emitting diode through the sixth transistor.

Another inventive aspect is a display panel, including a pixel circuit. The pixel circuit includes a first transistor, configured to respond to a first scanning line signal and to transmit a first signal voltage, a first capacitor, configured to store the first signal voltage, and an organic light emitting diode. The pixel circuit also includes a second transistor, configured to provide a drive current to the organic light emitting diode, a third transistor, configured to respond to a second scanning line signal and to transmit a first potential signal to the second transistor, and a fourth transistor, configured to respond to the first scanning line signal and to electrically connect a first electrode of the second transistor to a third electrode of the second transistor to form a diode connection of the second transistor. The pixel circuit also includes a fifth transistor, configured to respond to a third scanning line signal and to transmit a second signal voltage to the second transistor, and a sixth transistor, configured to respond to a light emitting scanning line signal, to receive the drive current of the second transistor, and to output the drive current to the organic light emitting diode.

BRIEF DESCRIPTION OF THE DRAWINGS

To illustrate technical solutions in the embodiments of the present disclosure more clearly, a brief introduction on the accompanying drawings which are needed in the description of the embodiments is given below. Apparently, the accompanying drawings in the description below are merely some of the embodiments of the present disclosure, other drawings may be obtained based on these drawings by those of ordinary skill in the art without any creative effort.

DETAILED DESCRIPTION OF THE PREFERRED EMBODIMENTS

A clear and complete description of technical solutions in the embodiments of the present disclosure will be given below in combination with the accompanying drawings in the embodiments of the present disclosure. Apparently, the embodiments described are merely a part, but not all, of the embodiments of the present disclosure. All of other embodiments, obtained by those of ordinary skill in the art based on the embodiments of the present disclosure without any creative effort, fall into the protection scope of the present disclosure.

Figure 1A:
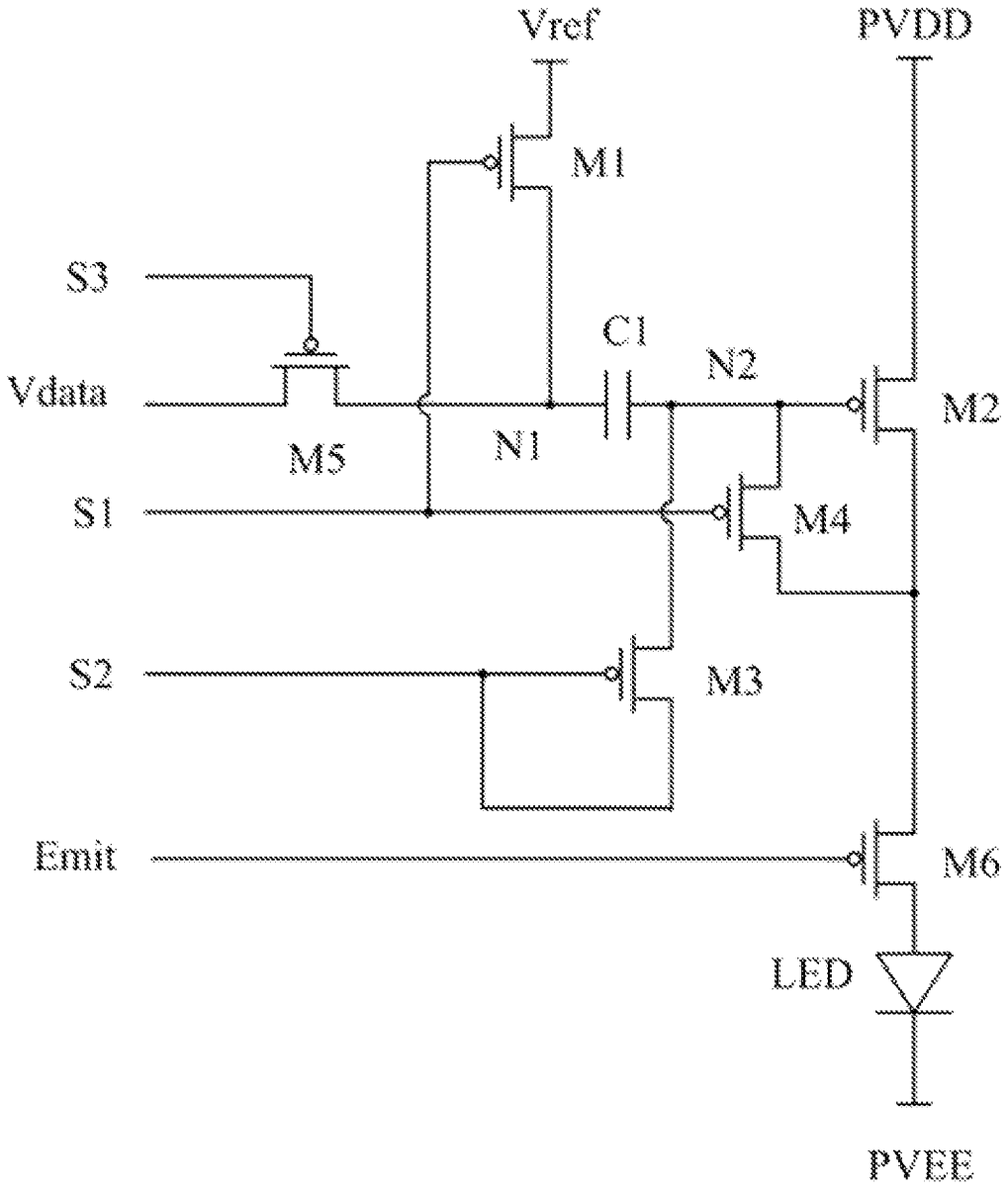
FIG. 1*a* is a circuit structure diagram of a pixel circuit provided by an embodiment of the present disclosure.

As shown in FIG. 1*a*, it is a circuit structure diagram of a pixel circuit provided by an embodiment of the present disclosure, and the pixel circuit includes: a first transistor M1, a second transistor M2, a third transistor M3, a fourth transistor M4, a fifth transistor M5, a sixth transistor M6 and a first capacitor C1.

The first electrode of the first transistor M1, is electrically connected with a input electrode S1 of a first scanning line signal, responding to a first scanning line signal, the second electrode is electrically connected with a first signal voltage input electrode for receiving a first signal voltage Vref, the third electrode is electrically connected with the first electrode of the first capacitor C1 and the third electrode of the fifth transistor M5, and the connecting point is a first node N1. When the first transistor M1 responds to the first scanning line signal transmitted by the input electrode S1 of the first scanning line signal to be turned on, the first transistor M1 transmits the first signal voltage Vref to the first node N1.

The first electrode of the second transistor M2 is electrically connected with the second electrode of the first capacitor C1 and the second electrode of the fourth transistor, the connecting point is a second node N2, the second electrode is electrically connected with a input electrode of a first power supply voltage for receiving a first power supply voltage PVDD, and the third electrode is electrically connected with the third electrode of the fourth transistor M4 and the second electrode of the sixth transistor M6. When the second transistor M2 is on, the second transistor M2 transmits current to an organic light emitting diode LED, and the transmitted current is determined by the voltage on the first electrode of the second transistor M2.

The first electrode of the third transistor M3 is electrically connected with a input electrode S2 of a second scanning line signal for responding to a second scanning line signal, the second electrode is electrically connected with the second node N2, and the third electrode is electrically connected to the first electrode thereof. When the third transistor M3 responds to the second scanning line signal to be turned on, the third electrode thereof is electrically connected to the first electrode thereof so as to transmit a first potential signal to the second node N2.

The first electrode of the fourth transistor M4 is electrically connected with the input electrode S1 of first scanning line signal for responding to the first scanning line signal, the second electrode is electrically connected with the second node N2, and the third electrode is electrically connected with the third electrode of the second transistor M2 and the second electrode of the sixth transistor M6. Since the second electrode thereof is electrically connected with the first electrode of the second transistor M2, and the third electrode thereof is electrically connected with the third electrode of the second transistor M2, when the fourth transistor M4 responds to the first scanning line signal to be turned on, the second transistor M2 forms a connecting manner of a diode.

The first electrode of the fifth transistor M5, is electrically connected with a third scanning line signal input electrode S3, responding to a third scanning line signal, the second electrode, is electrically connected with a second signal voltage input electrode, responding to a second signal voltage Vdata, and the third electrode is electrically connected with the first node N1. The fifth transistor M5 transmits the second signal voltage Vdata to the first node N1 when being turned on for responding to the third scanning line signal.

The first electrode of the sixth transistor M6 is electrically connected with a input electrode Emit of light emitting scanning line signal for responding to a light emitting scanning line signal, the second electrode is electrically connected with the third electrode of the second transistor M2 and the third electrode of the fourth transistor M4, and the third electrode is electrically connected with the second power supply voltage input electrode. The sixth transistor M6 transmits the current output by the second transistor M2 to the light emitting diode LED when being turned on for responding to the light emitting scanning line signal.

The first electrode of the first capacitor C1 is electrically connected with the first node N1, and the second electrode is electrically connected with the second node N2.

For all transistors in the above-mentioned pixel circuit, the first electrodes thereof are gate electrodes, the second electrodes thereof are source electrodes and can also be drain electrodes, which is determined by the type of the transistors (P type transistors or N type transistors), and the terms such as first electrodes and second electrodes are adopted herein for mutual distinction. For example, when the second electrodes of the transistors are source electrodes, the third electrodes thereof are drain electrodes; when the second electrodes of the transistors are drain electrodes, the third electrodes thereof are source electrodes. The description manner herein is adopted in the embodiments given below, and will not be repeated redundantly.

Figure 1B:
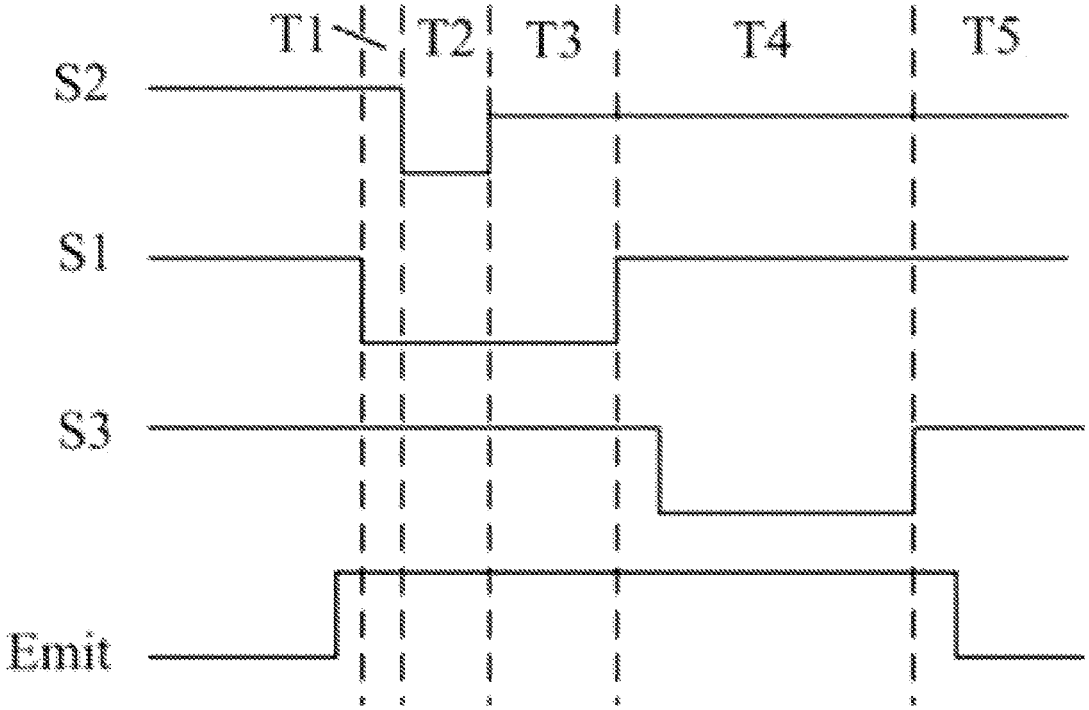
FIG. 1*b* is a time sequence control chart corresponding to the pixel circuit in FIG. 1*a;*

In the embodiment as shown in FIG. 1*a*, the transistors are all P type transistors, FIG. 1*b* shows a driving time sequence diagram of driving the pixel circuit shown in FIG. 1*a*, wherein:

During the first time sequence T1 stage, the input electrode S1 of the first scanning line signal inputs a low level scanning line signal, at this time, the first transistor M1 and the fourth transistor M4 are turned on, the first signal voltage Vref is transmitted to the first node N1 through the first transistor M1, and since the first electrode of the first capacitor C1 is electrically connected with the first node, the first signal voltage Vref is kept at the first node N1.

During the second time sequence T2 stage, the input electrode S2 of the second scanning line signal inputs a low level scanning line signal, at this time, the third transistor M3 is turned on, since the third electrode of the third transistor M3 is electrically connected with the first electrode, the first potential signal (the low level scanning line signal) input from the input electrode S2 of the second scanning line signal is transmitted to the second node N2 and the gate electrode of the second transistor M2, the potential at the gate electrode of the second transistor M2 is reset in this process, and meanwhile, the second transistor M2 is turned on;

During the third time sequence T3 stage, since the second transistor M2 and the fourth transistor M4 are on, the second transistor M2 is at a connecting state of a diode, at this time, the first power supply voltage PVDD is transmitted to the gate electrode of the second transistor M2 through the second transistor M2 and the fourth transistor M4 until the potential at the gate electrode of the second transistor M2 is (PVDD−Vth), the second transistor M2 is cut off, the transmission is completed, and a threshold is grabbed in this process;

During the fourth time sequence T4 stage, the third scanning line signal input electrode S3 inputs a low level scanning line signal, the fifth transistor M5 is turned on, at this time, the second signal voltage Vdata is transmitted to the first node N1 through the fifth transistor M5, since the voltage value of the second signal voltage Vdata is smaller than that of the first signal voltage Vref, and due to the coupling effect of the first capacitor C1, the potential of the second node N2 is changed into (PVDD−Vth)+(Vdata−Vref);

During the fifth time sequence T5 stage, the input electrode Emit of the light emitting scanning line signal inputs a low level scanning line signal, the sixth transistor M6 is turned on, the drive current corresponding to the potential at the second node N2 flows to the organic light emitting diode LED through the sixth transistor, and the organic light emitting diode LED emits light.

By adopting the pixel circuit as shown in FIG. 1*a*, the condition that the light emitting diode LED is turned on to emit light when resetting the potential of the gate electrode of the second transistor M2 (driving transistor) can be effectively avoided to improve the contrast ratio of the OLED display panel, meanwhile, the circuit has a simple structure, and the entire pixel circuit is composed of pure P type transistors, so that the making process thereof is simple and convenient.

Figure 1C:
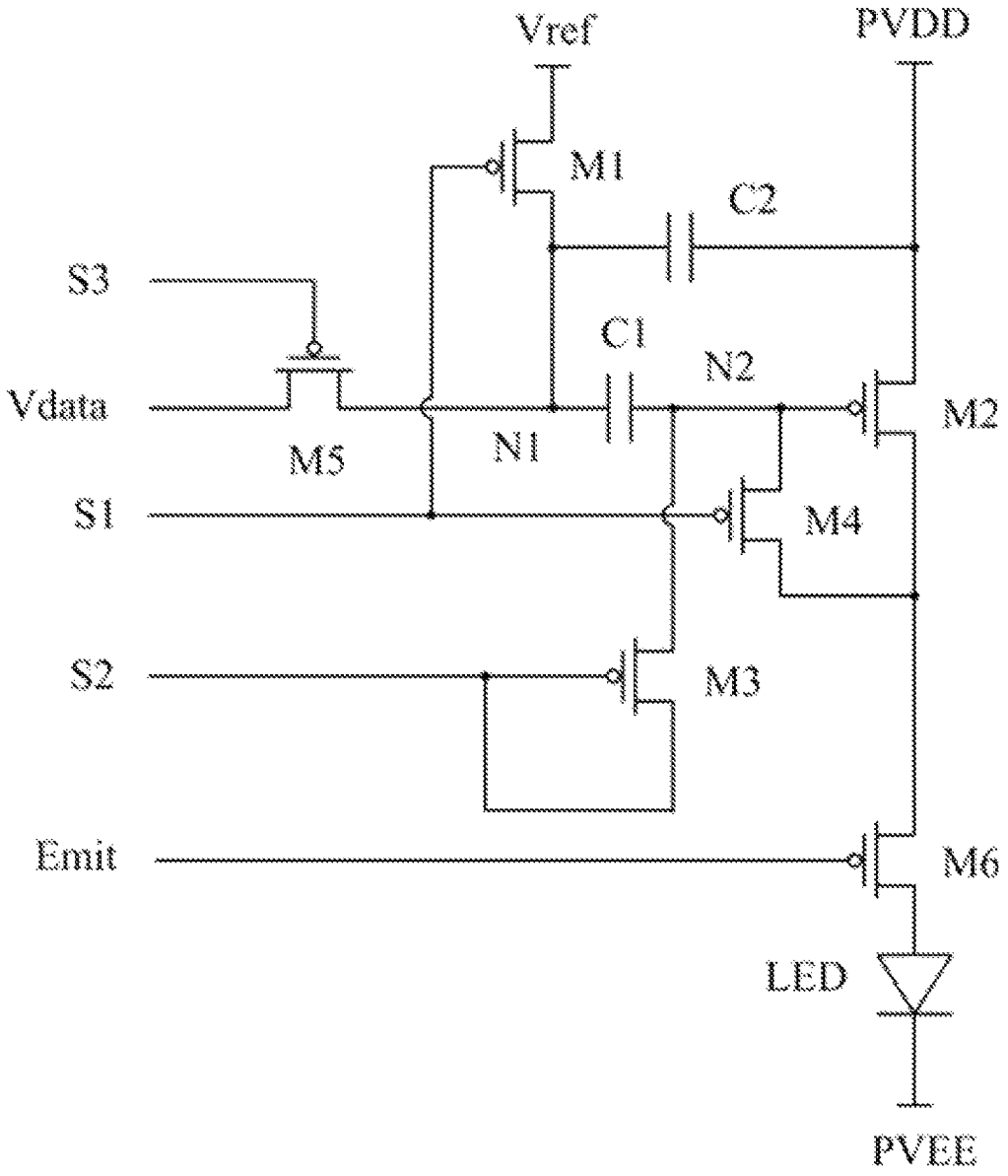
FIG. 1*c* is a circuit structure diagram of a pixel circuit provided by an embodiment of the present disclosure.

In the embodiment as shown in FIG. 1*a*, the pixel circuit can further include a second capacitor C2, the first electrode of the second capacitor C2 is electrically connected to the first node N1, the second electrode thereof is electrically connected to the first power supply voltage input electrode, the circuit structure diagram thereof is as shown in FIG. 1*c*, but the driving time sequence thereof is unchanged, and the driving time sequence diagram shown in FIG. 1*b* is still applicable herein. The beneficial effects of adding the second capacitor C2 lie in that, the capacitance value of the first capacitor C1 can not be too large during design, if the capacitance value is too large, the potential storage capacity of the first capacitor C1 is reinforced, but its own coupling effect is reinforced as well, meanwhile, since the second signal voltage Vdata is instable when the entire panel is at a working state and changes frequently thus influence the change of the potential of the first node N1, similarly, due to the coupling effect of the capacitor, the change of the potential of the first node N1 will greatly influence the potential of the second node N2, and this is unbeneficial to the work of the entire circuit; however, the capacitance value of the first capacitor C1 can not be too small neither, if the capacitance value is too small, the potential storage capacity is relatively weak, and this is unbeneficial to the work of the entire circuit, therefore, in order to ensure that the capacitor C1 has larger potential storage capacity and prevent excessive strong coupling effect thereof, one second capacitor C2 is added herein, the second capacitor C2 achieves a potential storage effect together with the first capacitor C1, such that the stability of the entire pixel circuit is better.

Figure 1D:
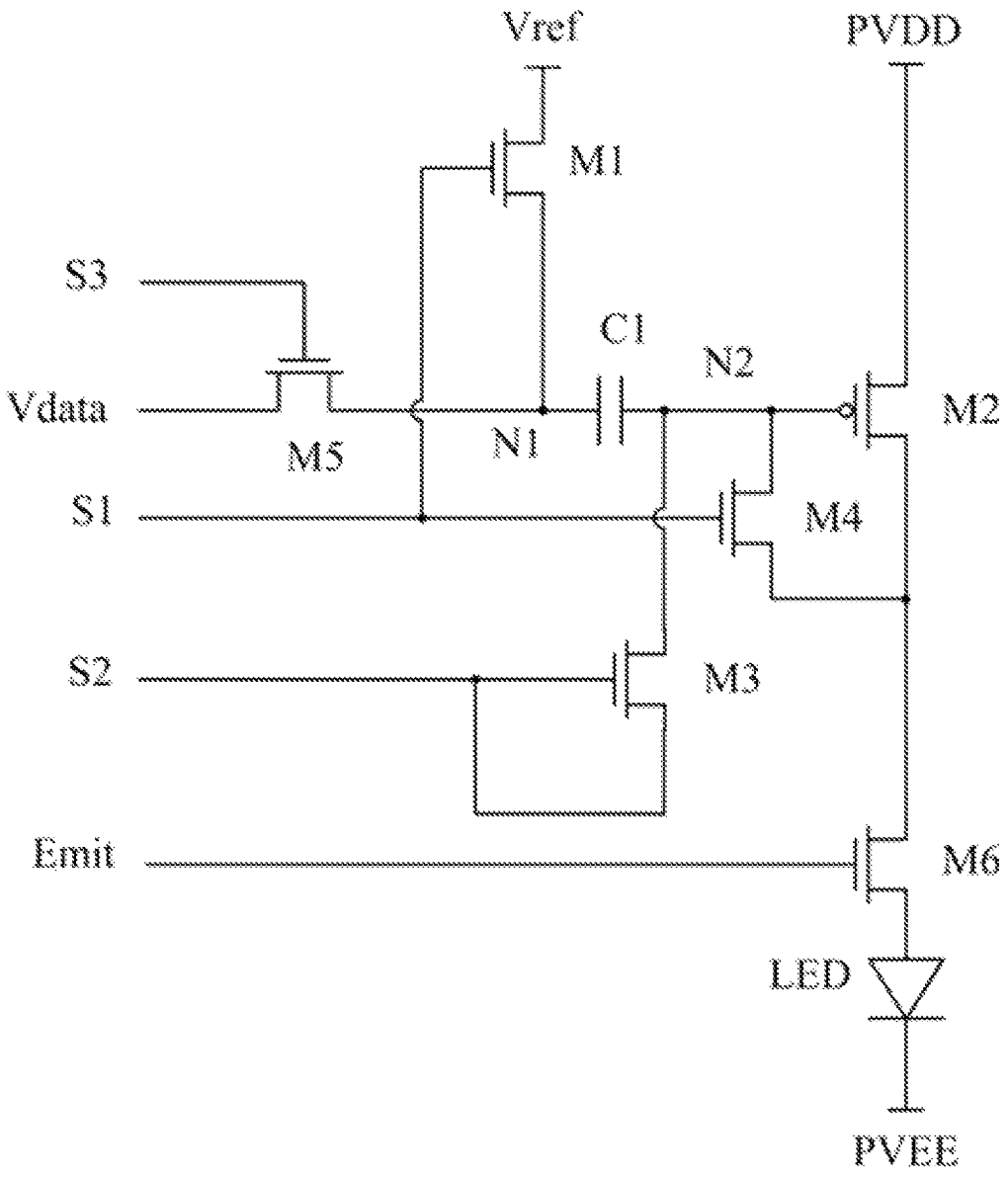
FIG. 1*d* is a circuit structure diagram of a pixel circuit provided by an embodiment of the present disclosure.
Figure 1E:
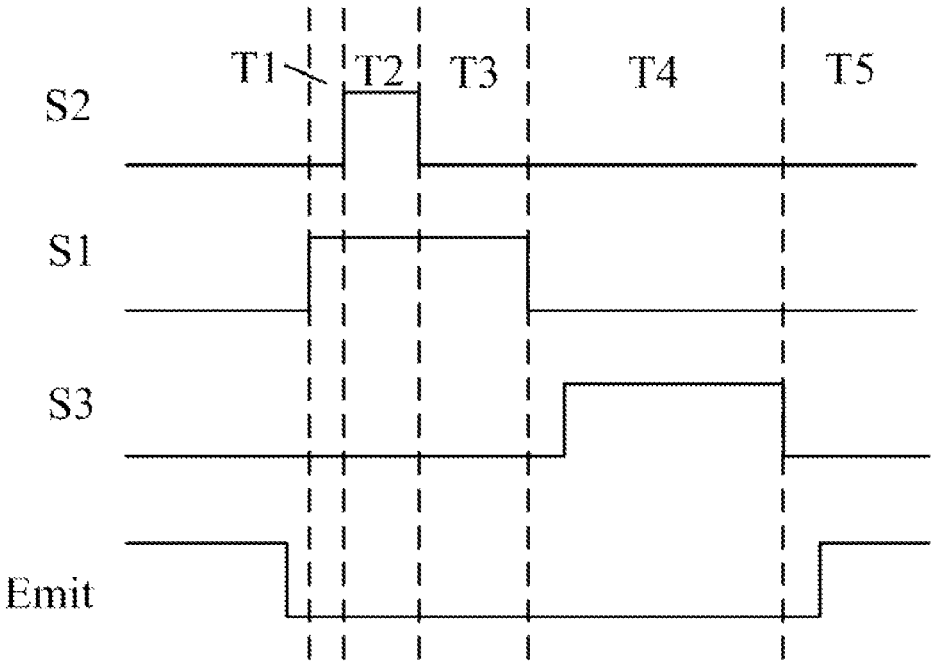
FIG. 1*e* is a time sequence control chart corresponding to the pixel circuit in FIG. 1*d;*

In the embodiment shown in FIG. 1*a*, wherein the first transistor M1, the third transistor M3, the fourth transistor M4, the fifth transistor M5 and the sixth transistor M6 can be changed into NMOS transistors, the second transistor M2 is still the PMOS transistor, the circuit structure diagram thereof is as shown in FIG. 1*d*, the driving time sequence thereof is just opposite to the driving time sequence diagram shown in FIG. 1*b* of the pixel circuit shown in FIG. 1*a*, namely, the low level in the driving time sequence diagram shown in FIG. 1*b* is changed into high level, and the high level is changed into low level, as shown in FIG. 1*e*, therefore, the driving process shown in FIG. 1*e* is not repeated redundantly herein and can specifically refer to the foregoing driving process. The beneficial effects of changing the pixel circuit from the original pure P type pixel circuit into the CMOS circuit lie in that, the TFT characteristic curve of the NMOS tube is better, thus being beneficial to the work of the entire pixel circuit.

Figure 1F:
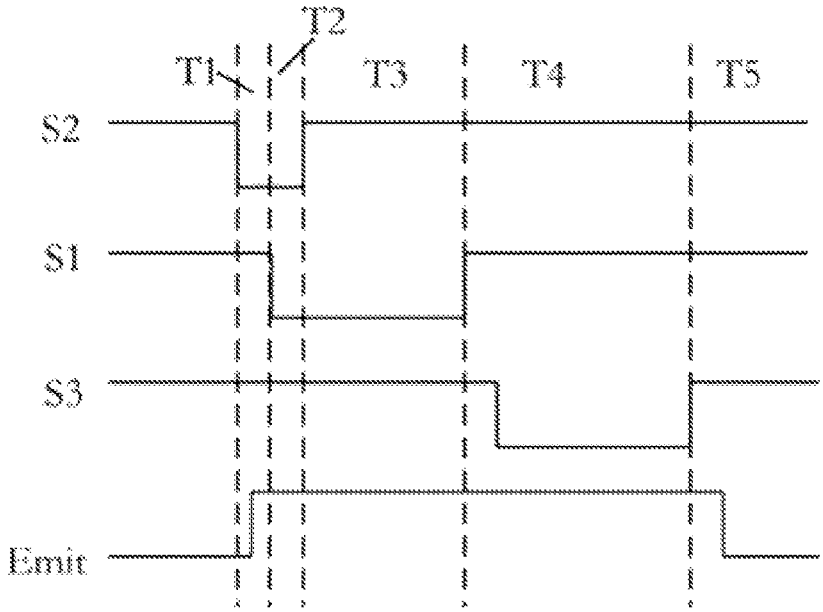
FIG. 1*f* is a time sequence control chart provided by an embodiment of the present disclosure.

In the embodiment shown in FIG. 1*a*, in the driving time sequence diagram FIG. 1*b* corresponding to the pixel circuit shown in FIG. 1*a*, the second scanning line signal input from the input electrode S2 of the second scanning line signal can be properly advanced, but the signal must be overlapped with the first scanning line signal input by the input electrode S1 of the first scanning line signal on the time sequence, as shown in FIG. 1*f*, therefore, according to the driving time sequence shown in FIG. 1*f*, the difference between this driving time sequence and the driving time sequence shown in FIG. 1*b* lies in that, the driving sequences of the transistors during the first stage T1 and the second stage T2 are different, only the specific conditions during the first stage T1 and the second stage T2 of the driving time sequence shown in FIG. 1*f* will be described next, the driving manners at other stages can refer to the condition of the driving time sequence shown in FIG. 1*b*, and will not be repeated redundantly.

During the first stage T1, the input electrode S2 of the second scanning line signal inputs a low level scanning line signal, at this time, the third transistor M3 is turned on, since the third electrode of the third transistor M3 is electrically connected with the first electrode, the first potential signal (a low potential voltage) input from the input electrode S2 of the second scanning line signal is transmitted to the second node N2 and the gate electrode of the second transistor M2, the potential at the gate electrode of the second transistor M2 is reset in this process, and meanwhile, the second transistor M2 is turned on.

During the second time sequence T2 stage, the input electrode S1 of the first scanning line signal inputs a low level scanning line signal, at this time, the first transistor and the fourth transistor M4 are turned on, the first signal voltage Vref is transmitted to the first node N1 through the first transistor M1, and since the first electrode of the first capacitor C1 is electrically connected with the first node, the first signal voltage Vref is kept at the first node N1.

Figure 1G:
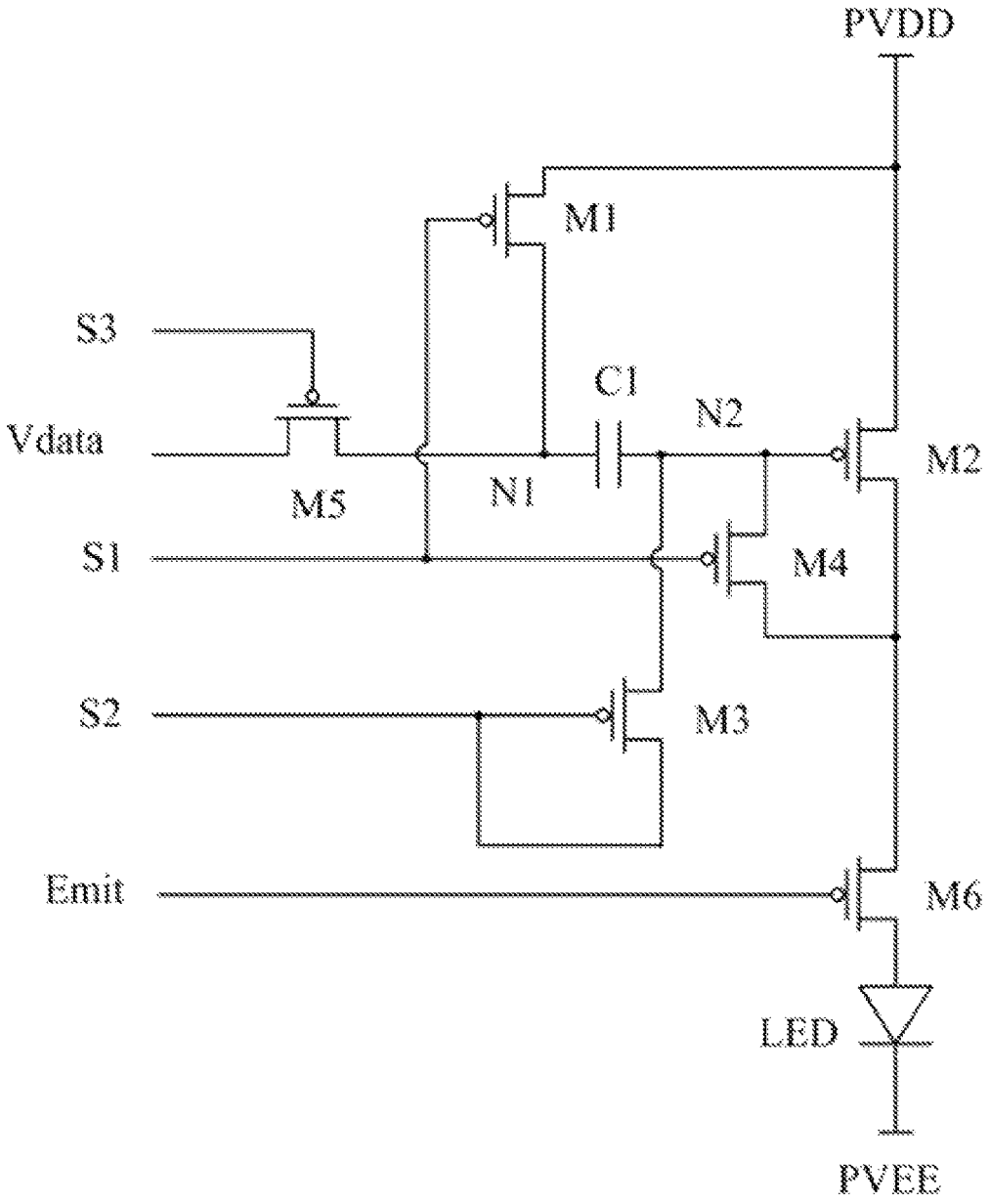
FIG. 1*g* is a circuit structure diagram of a pixel circuit provided by an embodiment of the present disclosure.

In the embodiment shown in FIG. 1*a*, the first electrode of the first transistor M1 can also be electrically connected to the first power supply voltage input electrode directly for receiving the first power supply voltage PVDD, as shown in FIG. 1*g*, but the driving time sequence thereof is unchanged, and the driving time sequence diagram shown in FIG. 1*b* is still applicable herein. The beneficial effects of electrically connecting the first electrode of the first transistor M1 to the first power supply voltage input electrode directly lie in that, space is saved on the layout design of the display panel, and the first power supply voltage PVDD is more stable than the first signal voltage Vref, which is beneficial to the work of the entire circuit.

Figure 2A:
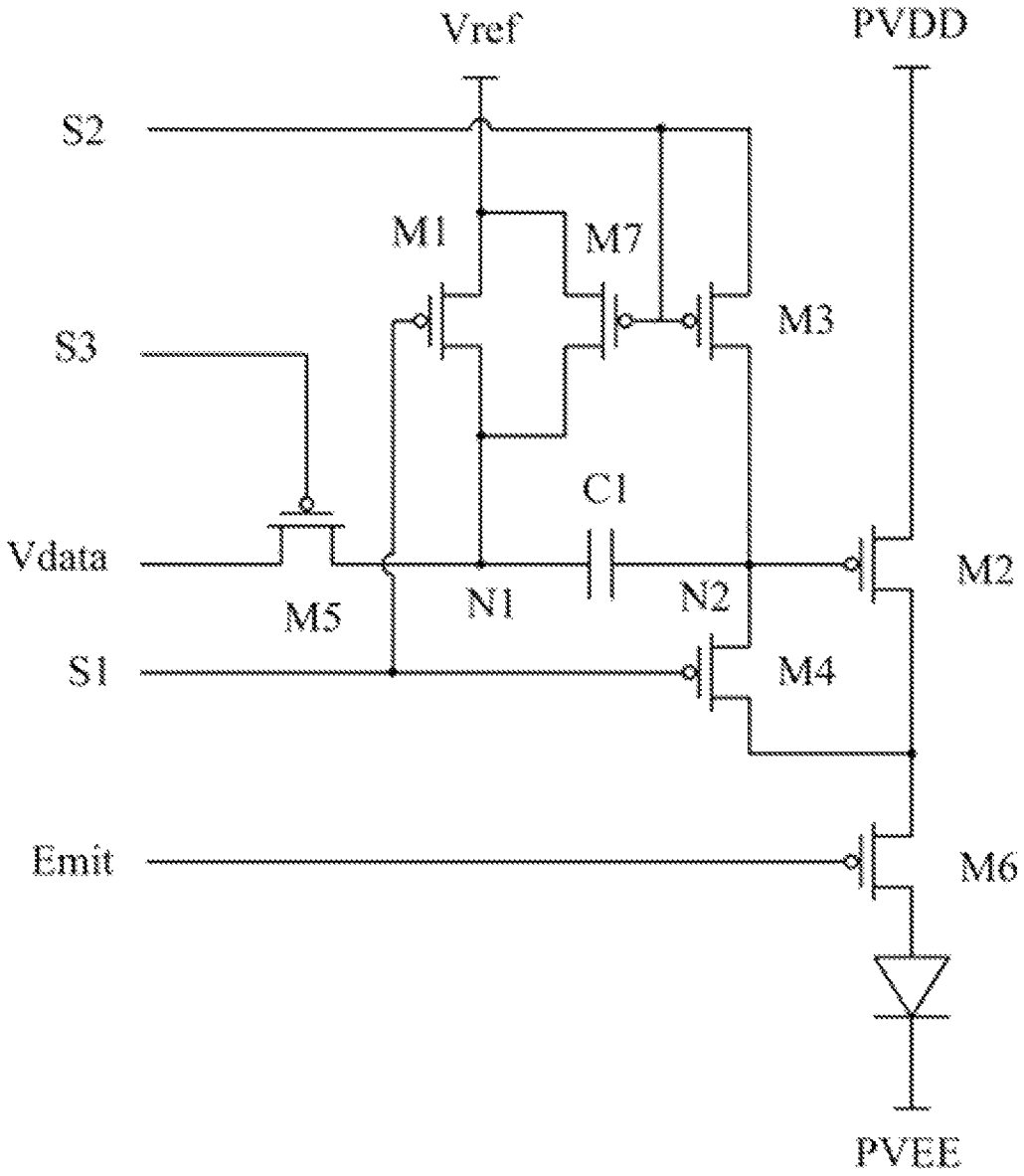
FIG. 2*a* is a circuit structure diagram of another pixel circuit provided by an embodiment of the present disclosure.

FIG. 2*a* shows a circuit structure diagram of a pixel circuit provided by an embodiment of the present disclosure, the difference between this circuit structure and the circuit structure in the embodiment shown in FIG. 1 lies in that, a seventh transistor M7 is added, the first electrode of the seventh transistor M7, is electrically connected with the input electrode S2 of the second scanning line signal, responding to the second scanning line signal, the second electrode is electrically connected with the first signal voltage input electrode for receiving the first signal voltage Vref, and the third electrode is electrically connected with the first node N1. When the seventh transistor M7 responds to the second scanning line signal to be turned on, the seventh transistor M7 transmits the first signal voltage Vref to the first node N1. Excluding the added seventh transistor M7, the connecting manners of all the remaining transistors and the first capacitor are the same as the connecting manners in the embodiment shown in FIG. 1*a*, can refer to the foregoing contents and will not be repeated redundantly herein.

Figure 2B:
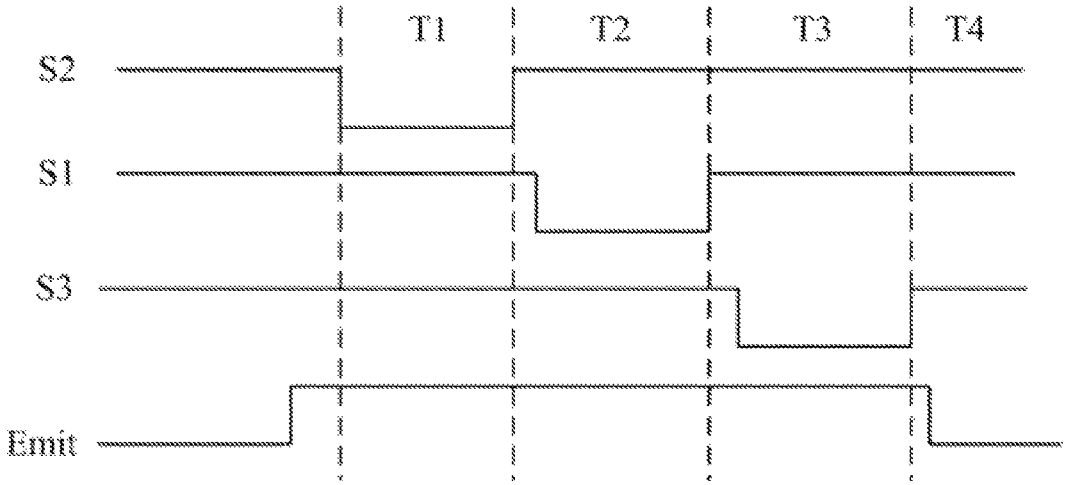
FIG. 2*b* is a time sequence control chart corresponding to the pixel circuit in FIG. 2*a;*

In the embodiment shown in FIG. 2*a*, the transistors are all P type transistors, FIG. 2*b* shows a driving time sequence diagram of driving the pixel circuit shown in FIG. 2*a*, wherein:

during the first time sequence T1 stage, the second scanning line signal input electrode S2 inputs a low level scanning line signal, at this time, the third transistor M3 and the seventh transistor M7 are turned on, the first signal voltage Vref is transmitted to the first node N1 through the seventh transistor M7, and since the first electrode of the first capacitor C1 is electrically connected with the first node, the first signal voltage Vref is kept at the first node N1, meanwhile, the first potential signal (the low level scanning line signal) input from the second scanning line signal input electrode S2 is transmitted to the second node N2 and the gate electrode of the second transistor M2, the potential of the gate electrode of the second transistor M2 is reset in this process, and meanwhile, the second transistor M2 is turned on;

during the second time sequence T2 stage, the input electrode S1 of the first scanning line signal inputs a low level scanning line signal, at this time, the first transistor M1 and the fourth transistor M4 are turned on, the first signal voltage Vref is transmitted to the first node N1 through the first transistor M1 again to consistently keep the stability of the potential of the first node N1, meanwhile, since the second transistor M2 and the fourth transistor M4 are on, the second transistor M2 is at a connecting state of a diode, at this time, the first power supply voltage PVDD is transmitted to the gate electrode of the second transistor M2 through the second transistor M2 and the fourth transistor M4 until the potential at the gate electrode of the second transistor M2 is (PVDD−Vth), the second transistor M2 is cut off, the transmission is completed, and the threshold is grabbed in this process;

during the third time sequence T3 stage, the input electrode S3 of the third scanning line signal inputs a low level scanning line signal, the fifth transistor M5 is turned on, at this time, the second signal voltage Vdata is transmitted to the first node N1 through the fifth transistor M5, since the voltage value of the second signal voltage Vdata is smaller than that of the first signal voltage Vref, and due to the coupling effect of the first capacitor C1, the potential of the second node N2 is changed into (PVDD−Vth)+(Vdata−Vref);

during the fourth time sequence T4 stage, the input electrode Emit of the light emitting scanning line signal inputs a low level scanning line signal, the sixth transistor M6 is turned on, the drive current corresponding to the potential at the second node N2 flows to the organic light emitting diode LED through the sixth transistor, and the organic light emitting diode LED emits light.

By adopting the pixel circuit as shown in FIG. 2*a*, the condition that the light emitting diode LED is electrified to emit light when resetting the potential of the gate electrode of the second transistor M2 (driving tube) can be effectively avoided to improve the contrast ratio of the OLED display panel, meanwhile, the circuit has a simple structure, and the entire pixel circuit is composed of pure P type transistors, so that the making process thereof is simple and convenient. The difference between this embodiment and the embodiment shown in FIG. 1*a* lies in that, one seventh transistor M7 is added, meanwhile, the driving time sequence shown in FIG. 2*b* is different from the driving time sequence shown in FIG. 1*b*, and the beneficial effects of adopting the design lie in that, the time sequence wave forms for driving the scanning signals are the same, and the entire panel is more convenient to drive.

Figure 2C:
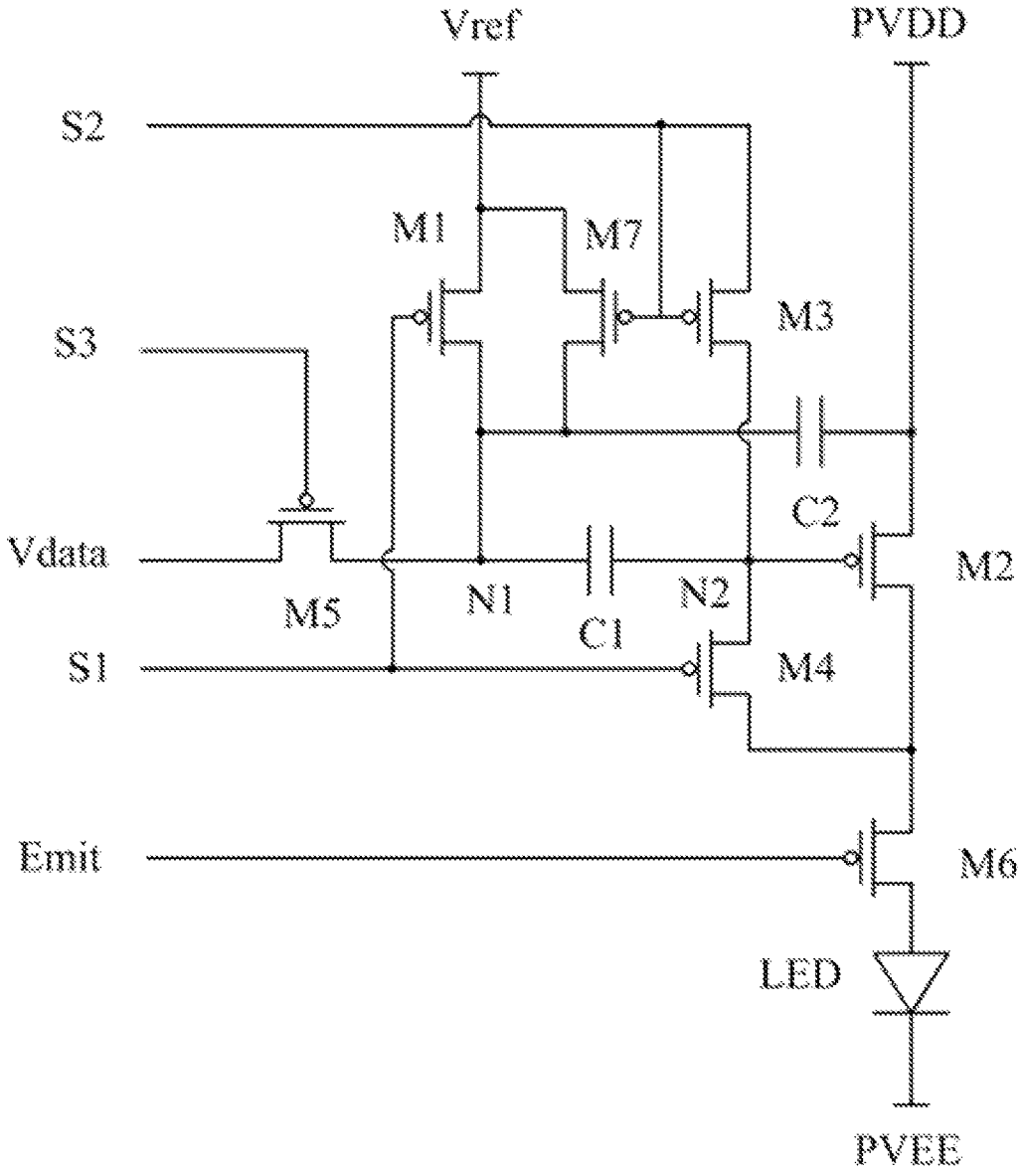
FIG. 2*c* is a circuit structure diagram of a pixel circuit provided by an embodiment of the present disclosure.

In the embodiment shown in FIG. 2*a*, the pixel circuit can further include a second capacitor C2, the first electrode of the second capacitor C2 is electrically connected to the first node N1, the second electrode thereof is electrically connected to the first power supply voltage input electrode, the circuit structure diagram thereof is as shown in FIG. 2*c*, the driving time sequence thereof is unchanged, and the driving time sequence diagram shown in FIG. 2*b* is still applicable herein. The beneficial effects of adding the second capacitor C2 lie in that, the capacitance value of the first capacitor C1 can not be too large during design, if the capacitance value is too large, the potential storage capacity of the first capacitor C1 is reinforced, but its own coupling effect is reinforced as well, meanwhile, since the second signal voltage Vdata is instable when the entire panel is at a working state and changes frequently to influence the change of the potential of the first node, similarly, due to the coupling effect of the capacitor, the change of the potential of the first node N1 will greatly influence the potential of the second node N2, and this is unbeneficial to the work of the entire circuit; however, the capacitance value of the first capacitor C1 can not be too small neither, if the capacitance value is too small, the potential storage capacity is relatively weak, and this is unbeneficial to the work of the entire circuit, therefore, in order to ensure that the capacitor C1 has larger potential storage capacity and prevent excessive strong coupling effect thereof, one second capacitor C2 is added herein, the second capacitor C2 achieves a potential storage effect together with the first capacitor C1, such that the stability of the entire pixel circuit is better.

Figure 2D:
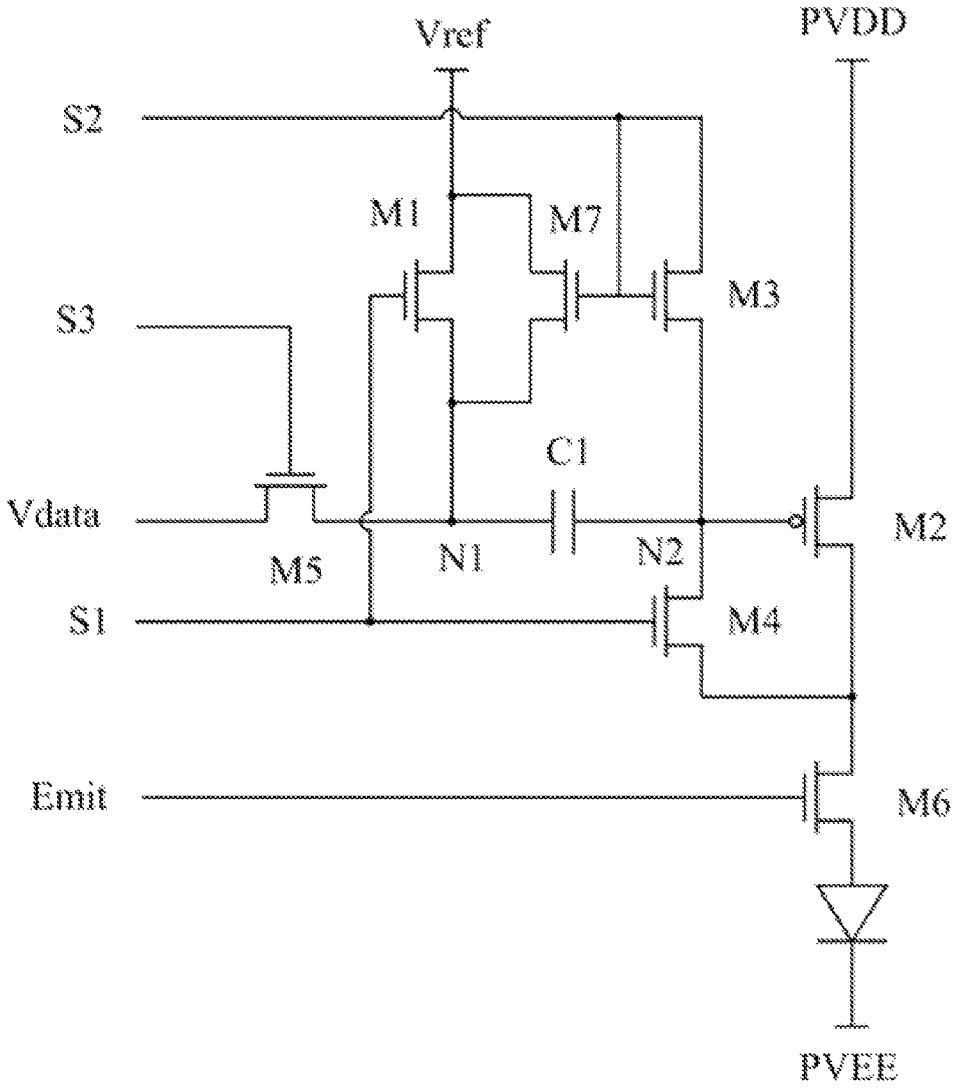
FIG. 2*d* is a circuit structure diagram of a pixel circuit provided by an embodiment of the present disclosure.
Figure 2E:
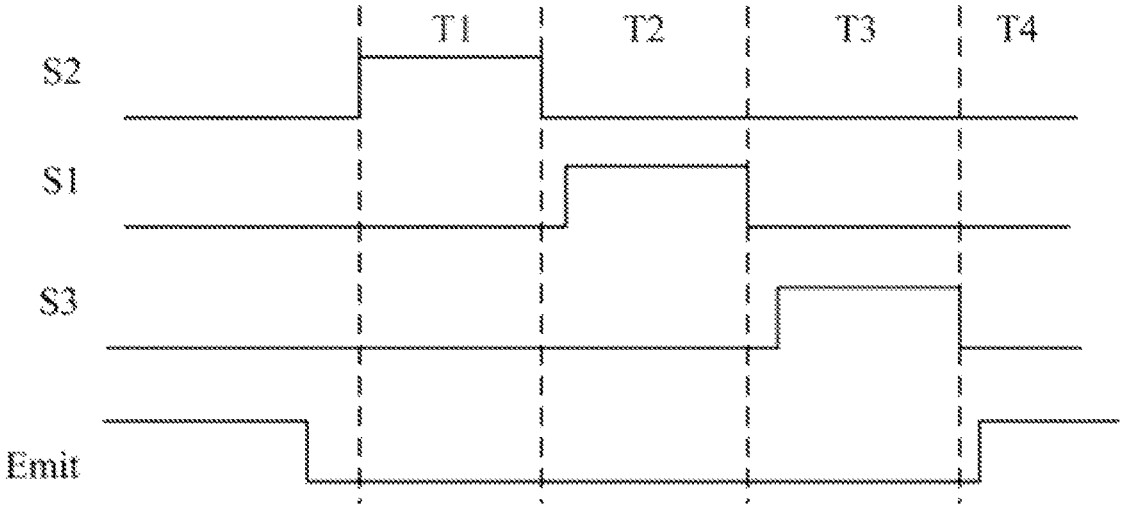
FIG. 2*e* is a time sequence control chart corresponding to the pixel circuit in FIG. 2*d;*

In the embodiment shown in FIG. 2*a*, wherein the first transistor M1, the third transistor M3, the fourth transistor M4, the fifth transistor M5, the sixth transistor M6 and the seventh transistor M7 can be changed into NMOS transistors, the second transistor M2 is still the PMOS transistor, the circuit structure diagram thereof is as shown in FIG. 2*d*, the driving time sequence thereof is just opposite to the driving time sequence diagram FIG. 2*b* of the pixel circuit shown in FIG. 2*a*, namely, the low level in the driving time sequence diagram FIG. 2*b* is changed into high level, and the high level is changed into low level, as shown in FIG. 2*e*, therefore, the driving process shown in FIG. 2*e* is not repeated redundantly herein and can specifically refer to the foregoing driving process. The beneficial effects of changing the pixel circuit from the original pure P type pixel circuit into the CMOS circuit lie in that, the TFT characteristic curve of the NMOS tube is better, thus being beneficial to the work of the entire pixel circuit.

Figure 2F:
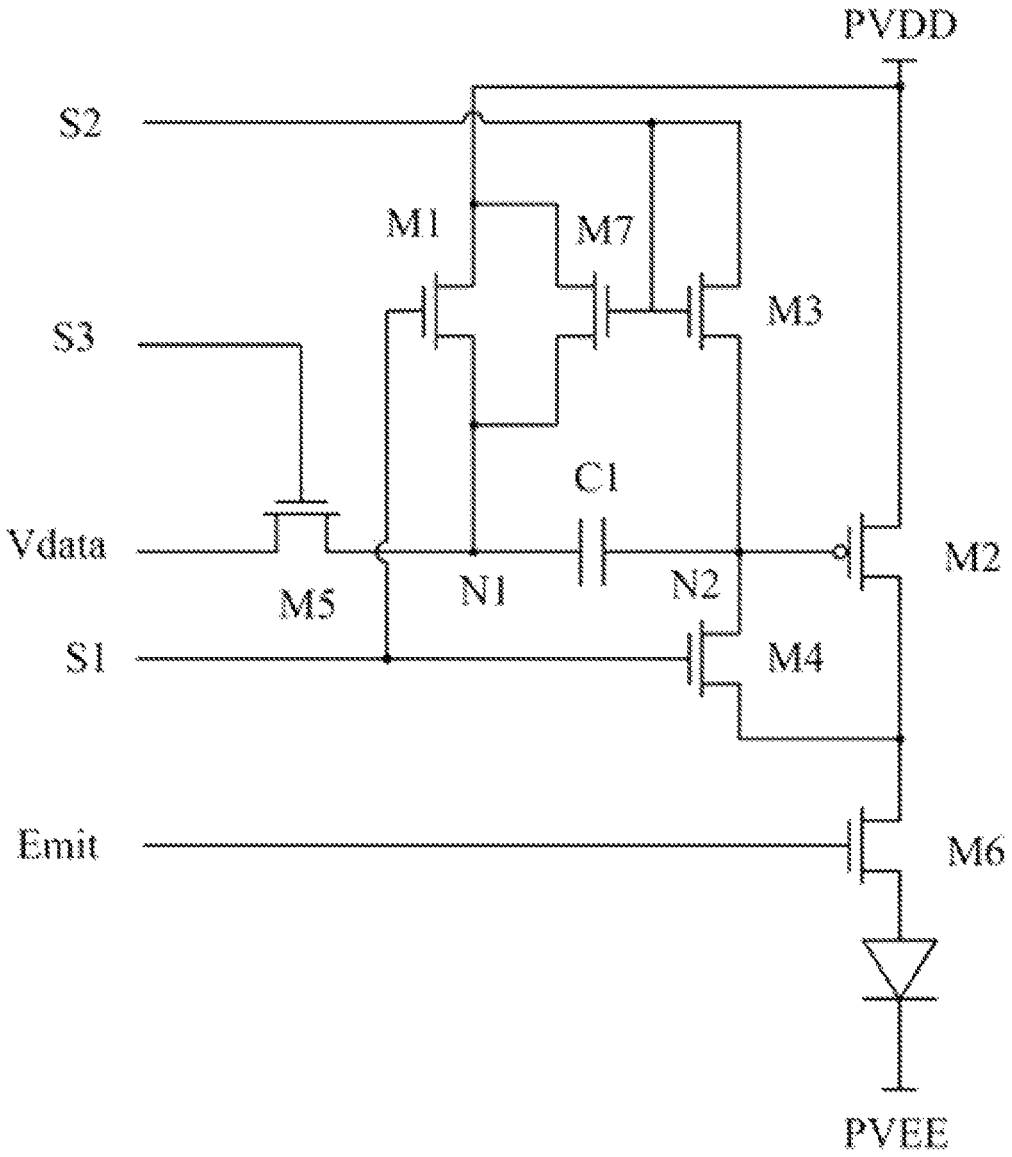
FIG. 2*f* is a circuit structure diagram of a pixel circuit provided by an embodiment of the present disclosure.

In the embodiment shown in FIG. 2*a*, the first electrode of the first transistor M1 can also be electrically connected to the first power supply voltage input electrode directly for receiving the first power supply voltage PVDD, as shown in FIG. 2*f*, but the driving time sequence thereof is unchanged, and the driving time sequence shown in FIG. 2*b* is still applicable herein. The beneficial effects of electrically connecting the first electrode of the first transistor M1 to the first power supply voltage input electrode directly lie in that, space is saved on the layout design of the display panel, and the first power supply voltage PVDD is more stable than the first signal voltage Vref, which is beneficial to the work of the entire circuit.

To sum up, compared with the traditional pixel circuit, the pixel circuit and the driving method thereof provided by the present disclosure have the advantages that, when the driving transistor is at the gate potential reset stage, light emission of the light emitting diode can be avoided, and thus the contrast ratio of the OLED display panel is improved.

The circuit structure and the driving method of the pixel circuit provided by the embodiments of the present disclosure have been described above in detail, the principle and the implementations of the present disclosure are illustrated in this paper by use of specific examples, and the embodiments described above are merely used for helping to understand the method and the core concept thereof in the present disclosure; meanwhile, those of skilled in the art will make variations to the specific implementations and the application range according to the concept of the present disclosure, to sum up, the contents in the description should be understood as limitation to the present disclosure.

What is claimed is:

1. A pixel circuit, comprising:

a first transistor, configured to respond to a first scanning line signal and to transmit a first signal voltage to a first electrode of a first capacitor;

the first capacitor, configured to store the first signal voltage, wherein a second electrode of the first capacitor is connected to a gate electrode of a second transistor;

an organic light emitting diode arranged between a sixth transistor and a second power supply voltage;

the second transistor, configured to provide a drive current to the organic light emitting diode through the sixth transistor according to a potential at the gate electrode of the second transistor; wherein the second transistor is arranged between a first power supply voltage and the sixth transistor;

a third transistor, configured to respond to a second scanning line signal and to transmit a first potential signal on the second scanning line signal to the second electrode of the first capacitor, wherein a gate electrode of the third transistor is configured to receive the second scanning line signal, a second electrode of the third transistor is connected to the gate electrode of the second transistor, and a third electrode of the third transistor is connected to the gate electrode of the third transistor;

a fourth transistor, configured to respond to the first scanning line signal and to electrically connect a first electrode of the second transistor to a third electrode of the second transistor to form a diode connection of the second transistor, wherein the first power supply voltage is transmitted to the second electrode of the first capacitor through the second transistor;

a fifth transistor, configured to respond to a third scanning line signal and to transmit a second signal voltage to the first electrode of the first capacitor, wherein the potential at the second electrode of the first capacitor changes in response to the second signal voltage being transmitted to the first electrode of the first capacitor; and the sixth transistor, configured to respond to a light emitting scanning line signal, to receive the drive current of the second transistor, and to output the drive current to the organic light emitting diode.

2. The pixel circuit of claim 1, wherein:

the first transistor comprises a gate electrode configured to receive the first scanning line signal, a second electrode configured to receive the first signal voltage, and a third electrode connected to the first electrode of the first capacitor;

the second transistor comprises the gate electrode connected to the second electrode of the first capacitor, the second electrode configured to receive the first power supply voltage, and a third electrode connected to a second electrode of the sixth transistor;

the fourth transistor comprises a gate electrode configured to receive the first scanning line signal, a second electrode connected to the second electrode of the first capacitor, and a third electrode connected to the second electrode of the sixth transistor;

the fifth transistor comprises a gate electrode configured to receive the third scanning line signal, a second electrode connected to the first electrode of the first capacitor, and a third electrode configured to receive the second signal voltage;

the sixth transistor comprises a gate electrode configured to receive the light emitting scanning signal, the second electrode of the sixth transistor connected to the third electrode of the second transistor, and a third electrode configured to receive a second power supply voltage.

3. The pixel circuit of claim 2, wherein the first transistor, the second transistor, the third transistor, the fourth transistor, the fifth transistor, and the sixth transistor are PMOS transistors.

4. The pixel circuit of claim 2, wherein the first transistor, the third transistor, the fourth transistor, the fifth transistor, and the sixth transistor are NMOS transistors, and the second transistor is a PMOS transistor.

5. The pixel circuit of claim 2, further comprising a second capacitor, wherein a first electrode of the second capacitor is connected to the first electrode of the first capacitor, and a second electrode of the first capacitor is connected to the first power supply voltage.

6. The pixel circuit of claim 2, further comprising a seventh transistor, wherein the seventh transistor comprises a gate electrode configured to receive the second scanning line signal, a second electrode configured to receive the first signal voltage, and a third electrode connected to the first electrode of the first capacitor.

7. The pixel circuit of claim 6, wherein the first transistor, the second transistor, the third transistor, the fourth transistor, the fifth transistor, the sixth transistor, and the seventh transistor are PMOS transistors.

8. The pixel circuit of claim 6, wherein the first transistor, the third transistor, the fourth transistor, the fifth transistor, the sixth transistor, and the seventh transistor are NMOS transistors, and the second transistor is a PMOS transistor.

9. The pixel circuit of claim 6, further comprising a second capacitor, wherein a first electrode of the second capacitor is connected to the first electrode of the first capacitor, and a second electrode of the first capacitor is connected to the first power supply voltage.

10. The pixel circuit of claim 1, wherein the voltage of the first power supply voltage is in a range from 0 V to 5V, and the voltage of the second power supply voltage is in a range from −10 V to 0 V.

11. The pixel circuit of claim 1, wherein the voltage of the first signal voltage is in a range from 0 V to 5V, and the voltage of the second signal voltage is in a range from −5V to 0V.

12. A method of driving a pixel circuit, wherein the pixel circuit comprises:

a first transistor, configured to respond to a first scanning line signal and to transmit a first signal voltage;

a first capacitor, configured to store the first signal voltage;

an organic light emitting diode;

a second transistor, configured to provide a drive current to the organic light emitting diode;

a third transistor, configured to respond to a second scanning line signal and to transmit a first potential signal to the second transistor;

a fourth transistor, configured to respond to the first scanning line signal and to electrically connect a first electrode of the second transistor to a third electrode of the second transistor to form a diode connection of the second transistor;

a fifth transistor, configured to respond to a third scanning line signal and to transmit a second signal voltage to the second transistor;

a sixth transistor, configured to respond to a light emitting scanning line signal, to receive the drive current of the second transistor, and to output the drive current to the organic light emitting diode, wherein the first transistor comprises a gate electrode configured to receive the first scanning line signal, a second electrode configured to receive the first signal voltage, and a third electrode connected to a first electrode of the first capacitor, wherein the second transistor comprises a gate electrode connected to a second electrode of the first capacitor, a second electrode configured to receive a first power supply voltage, and a third electrode connected to a second electrode of the sixth transistor, wherein the third transistor comprises a gate electrode configured to receive the second scanning line signal, a second electrode connected to the second electrode of the first capacitor, and a third electrode connected to the gate electrode of the third transistor, wherein the fourth transistor comprises a gate electrode configured to receive the first scanning line signal, a second electrode connected to the second electrode of the first capacitor, and a third electrode connected to the second electrode of the sixth transistor, wherein the fifth transistor comprises a gate electrode configured to receive the third scanning line signal, a second electrode connected to the first electrode of the first capacitor, and a third electrode configured to receive the second signal voltage, wherein the sixth transistor comprises a gate electrode configured to receive the light emitting scanning signal, the second electrode of the sixth transistor connected to the third electrode of the second transistor, and a third electrode configured to receive a second power supply voltage, wherein the first electrode of the first capacitor is connected to the third electrode of the first transistor, and the second electrode of the first capacitor is connected to the gate electrode of the second transistor, the method comprising:

during a first time sequence stage, the first transistor and the fourth transistor turn on in response to the first scanning line signal, and the first signal voltage is transmitted to the first electrode of the first capacitor;

during a second time sequence stage, the third transistor turns on in response to the second scanning line signal, the first potential signal on the second scanning line signal is transmitted to the second electrode of the first capacitor to reset the gate electrode of the second transistor, and the second transistor is turned on;

during a third time sequence stage, the second transistor and the fourth transistor are on, the second transistor is diode connected, and the first power supply voltage is transmitted to the second electrode of the first capacitor through the second transistor;

during a fourth time sequence stage, the fifth transistor turns on in response to the third scanning line signal, the second signal voltage is transmitted to the first electrode of the first capacitor, and the potential at the second electrode of the first capacitor changes in response to the second signal voltage being transmitted to the first electrode of the first capacitor;

during a fifth time sequence stage, the sixth transistor turns on in response to the light emitting scanning line signal, and the drive current flows to the organic light emitting diode through the sixth transistor.

13. A method of driving a pixel circuit, wherein the pixel circuit comprises:

a first transistor, configured to respond to a first scanning line signal and to transmit a first signal voltage;

a first capacitor, configured to store the first signal voltage;

an organic light emitting diode;

a second transistor, configured to provide a drive current to the organic light emitting diode;

a third transistor, configured to respond to a second scanning line signal and to transmit a first potential signal to the second transistor;

a fourth transistor, configured to respond to the first scanning line signal and to electrically connect a first electrode of the second transistor to a third electrode of the second transistor to form a diode connection of the second transistor;

a fifth transistor, configured to respond to a third scanning line signal and to transmit a second signal voltage to the second transistor;

a sixth transistor, configured to respond to a light emitting scanning line signal, to receive the drive current of the second transistor, and to output the drive current to the organic light emitting diode, wherein the first transistor comprises a gate electrode configured to receive the first scanning line signal, a second electrode configured to receive the first signal voltage, and a third electrode connected to a first electrode of the first capacitor, wherein the second transistor comprises a gate electrode connected to a second electrode of the first capacitor, a second electrode configured to receive a first power supply voltage, and a third electrode connected to a second electrode of the sixth transistor, wherein the third transistor comprises a gate electrode configured to receive the second scanning line signal, a second electrode connected to the second electrode of the first capacitor, and a third electrode connected to the gate electrode of the third transistor, wherein the fourth transistor comprises a gate electrode configured to receive the first scanning line signal, a second electrode connected to the second electrode of the first capacitor, and a third electrode connected to the second electrode of the sixth transistor, wherein the fifth transistor comprises a gate electrode configured to receive the third scanning line signal, a second electrode connected to the first electrode of the first capacitor, and a third electrode configured to receive the second signal voltage, wherein the sixth transistor comprises a gate electrode configured to receive the light emitting scanning signal, the second electrode of the sixth transistor connected to the third electrode of the second transistor, and a third electrode configured to receive a second power supply voltage, wherein the first electrode of the first capacitor is connected to the third electrode of the first transistor, and the second electrode of the first capacitor is connected to the gate electrode of the second transistor, a seventh transistor, wherein the seventh transistor comprises a gate electrode configured to receive the second scanning line signal, a second electrode configured to receive the first signal voltage, and a third electrode connected to the first electrode of the first capacitor, the method comprising:

during a first time sequence stage, the third transistor and the seventh transistor turn on in response to the second scanning line signal, the first signal voltage is transmitted to the first electrode of the first capacitor through the seventh transistor, the first potential signal is transmitted to the second electrode of the first capacitor to reset the gate electrode of the second transistor, and the second transistor is turned on;

during a second time sequence stage, the first transistor and the fourth transistor turn on in response to the first scanning line signal, the first signal voltage is transmitted to the first electrode of the first capacitor through the first transistor, the second transistor is diode connected, and the first power supply voltage is transmitted to the second electrode of the first capacitor through the second transistor;

during a third time sequence stage, the fifth transistor turns on in response to the third scanning line signal, the second signal voltage is transmitted to the first electrode of the first capacitor, and the potential at the second electrode of the first capacitor changes in response to the second signal voltage being transmitted to the first electrode of the first capacitor;

during a fourth time sequence stage, the sixth transistor turns on in response to the light emitting scanning line signal, and the drive current flows to the organic light emitting diode through the sixth transistor.

14. A display panel, comprising a pixel circuit, wherein the pixel circuit comprises:

a first transistor, configured to respond to a first scanning line signal and to transmit a first signal voltage to a first electrode of a first capacitor;

the first capacitor, configured to store the first signal voltage, wherein a second electrode of the first capacitor is connected to a gate electrode of a second transistor;

an organic light emitting diode arranged between a sixth transistor and a second power supply voltage;

the second transistor, configured to provide a drive current to the organic light emitting diode through the sixth transistor according to a potential at the gate electrode of the second transistor; wherein the second transistor is arranged between a first power supply voltage and the sixth transistor;

a third transistor, configured to respond to a second scanning line signal and to transmit a first potential signal on the second scanning line signal to the second electrode of the first capacitor; wherein a gate electrode of the third transistor is configured to receive the second scanning line signal, a second electrode of the third transistor is connected to the gate electrode of the second transistor, and a third electrode of the third transistor is connected to the gate electrode of the third transistor;

a fourth transistor, configured to respond to the first scanning line signal and to electrically connect a first electrode of the second transistor to a third electrode of the second transistor to form a diode connection of the second transistor, wherein the first power supply voltage is transmitted to the second electrode of the first capacitor through the second transistor;

a fifth transistor, configured to respond to a third scanning line signal and to transmit a second signal voltage to the first electrode of the first capacitor, wherein the potential at the second electrode of the first capacitor changes in response to the second signal voltage being transmitted to the first electrode of the first capacitor;

the sixth transistor, configured to respond to a light emitting scanning line signal, to receive the drive current of the second transistor, and to output the drive current to the organic light emitting diode.

* * * * *